United States Patent [19]

Hoerger et al.

[11] 4,308,884

[45] Jan. 5, 1982

[54] METHOD FOR TRANSMISSION OF PRESSURE SIGNALS THROUGH A CONDUIT

[75] Inventors: Carl R. Hoerger, Logan, Utah; Brian W. Smith, Calgary, Canada

[73] Assignee: Exxon Production Research Company, Houston, Tex.

[21] Appl. No.: 171,686

[22] Filed: Jul. 24, 1980

[51] Int. Cl.[3] ..... F16K 31/12

[52] U.S. Cl. ..... 137/14; 137/624.11; 137/624.18; 91/471; 166/72

[58] Field of Search ..... 137/624.11, 624.18, 137/624.2, 1, 14; 91/471; 166/72, 319

[56] References Cited

U.S. PATENT DOCUMENTS

| | | | |
|---|---|---|---|
| 3,856,037 | 12/1974 | Garrett et al. | 166/72 X |
| 3,993,100 | 11/1976 | Pollard et al. | 137/628 |
| 4,062,379 | 12/1977 | Clinton | 137/565 |
| 4,119,146 | 10/1978 | Taylor | 166/72 |
| 4,185,541 | 1/1980 | Milberger et al. | 137/624.11 X |

*Primary Examiner*—Alan Cohan

*Attorney, Agent, or Firm*—Gary D. Lawson

[57] ABSTRACT

An improved method for transmitting fluid pressure signals through a conduit is disclosed wherein time delay is minimized. In the practice of this invention, a pressure pulse is applied to a conduit for a predetermined time interval and thereafter reduced to a maintenance level. The invention is particularly useful in sequentially controlling subsea oil well valves from a remote surface station.

11 Claims, 8 Drawing Figures

METHOD FOR TRANSMISSION OF PRESSURE SIGNALS THROUGH A CONDUIT

BACKGROUND OF THE INVENTION

1. Field of the Invention

This invention pertains generally to the rapid transmission of fluid pressure signals through pressure control lines and more particularly to the rapid actuation of pilot valves through a long fluid control line to operate a plurality of subsea oil well valves in a predetermined sequential manner.

2. Description of the Prior Art

In a fluid pressure control system, various mechanical equipment is actuated by applying a fluid pressure signal to the equipment through a fluid-filled conduit. More specifically, hydraulic control systems have been used in the oil production industry to actuate valves and other devices connected to an oil well. Such systems have been applied to underwater well installations to open and close subsea valves on the well by introducing a hydraulic signal into the control system from a remote source on the ocean surface. The subsea valves may be Christmas tree valves located on the ocean floor, safety valves located downhole beneath the ocean floor or manifold valves in a subsea production system. The remote pressure source may be a pump and hydraulic accumulator unit fixed on a platform on the ocean surface at some distance from the well and connected to the underwater devices through a long control line.

In the operation of several subsea well valves it is often desired to open or close each valve in a particular order. A control system, including sequenced pilot valves, is commonly used to accomplish this purpose. Each pilot valve is connected to a hydraulic power line leading to one of the well valves and controls the flow of power fluid to the well valve. The pilot valves are hydraulically actuated by input pressure signals applied through a pressure control line. Each pilot is triggered by a different minimal output pressure in the control line at the location of the pilots. Thus, the well valves can be operated in the desired sequence by applying incremental pressure steps to the control line to yield progressively increasing pressure levels at the pilots. Typically, in the conventional method, each input pressure step in the sequence is about 400 psi (28.1 kg/cm$^2$) and the increase in output pressure required to reach the next actuation pressure in the sequence is about 60% of the step or about 240 psi (16.9 kg/cm$^2$). It is critical that the step size and the pilot actuation settings be chosen so that, during the application of a certain pressure step to actuate one pilot, the pilot associated with the next step in the sequence is not inadvertently actuated. The operation of a pilot valve is described in U.S. Pat. No. 4,119,146. The use of pilot valves to control devices in a predetermined sequence is discussed in U.S. Pat. Nos. 3,856,037 and 3,993,100.

One shortcoming of the conventional fluid pressure control method is the delay between the time at which the pressure signal is applied to the conduit at the pressure source and the time at which the signal reaches the device and causes actuation. This time delay becomes particularly significant when a long pressure line is used as in the case of subsea well valves controlled from a remote surface facility. In such installations, the control line may be more than twenty kilometers in length and the system response time may be several minutes.

In the past, the time delay problem has been recognized and various solutions have been proposed. By increasing the inside diameter of the pressure conduit in a given system, the response time for transmitting a signal will be reduced. A drawback of this proposal, however, is the additional expense associated with providing a larger pump and a larger accumulator to accommodate the increased fluid volume. Another proposed solution is the use of a water-based fluid rather than an oil as the hydraulic fluid. While the system response time will be reduced due to the lower viscosity of a water-based fluid, the corrosion problems associated with the fluid system may be increased, wear may be accelerated and fluid life will be reduced.

SUMMARY OF THE INVENTION

The foregoing disadvantages of the conventional method for transmission of fluid pressure signals are substantially alleviated in accordance with the teachings of the present invention. In this invention, a pressure pulse is introduced to a fluid-filled conduit to actuate a pressure-responsive mechanical device connected to the conduit. The pulse applied is of a magnitude greater than the pressure step conventionally used in such a system for actuation. Application of the pulse is maintained for a time period shorter than the time required for actuation in the conventional pressure step method. The input pressure to the conduit is then adjusted to a maintenance level adequate to maintain actuation of the device and, preferably, equal to the standard pressure step level. According to the present invention, an individual device in a pressure-sequenced group of devices is actuated quickly by rapid attainment of its trigger pressure at the location of the devices. However, the local pressure at the devices is at all times maintained below the trigger pressure of the succeeding device in the sequence so that the succeeding device is not inadvertently actuated.

Preferably, the pressure pulse applied in the present invention is between about 1.5 and about 3.0 times the magnitude of the conventional pressure step and the application period for the pulse is between about 0.4 and about 0.8 times the trip time for the conventional pressure step. More preferably, the pulse magnitude is about two times the pressure step and the application period is about 0.75 times the trip time for the step input.

The optimal pulse magnitude and application period for the actuation of a particular device in a system are those which cause the most rapid actuation of the device and yet ensure that only that individual device is actuated. In one specific embodiment of the present invention, for a chosen pulse magnitude and maintenance pressure to be applied, an optimal pulse application period is determined by analyzing the known response of the system to an input pressure step equal in magnitude to the pulse chosen and to an input pressure equal to the maintenance pressure chosen.

In a preferred embodiment of this invention, the pulse applied is an increase in pressure, the actuation fluid is a hydraulic fluid and the device to be actuated is a valve. The invention is particularly useful in the remote actuation of sequenced pilot valves to open or close valves on an offshore oil well consecutively in a preselected order. Each pilot controls the admission of hydraulic power fluid to a related well valve. The pilot valves are connected in parallel to a single pressure control line which extends to a remote location and each is preset to be actuated at a different pressure level. A hydraulic pressure pulse is applied to the control line at its remote end to produce each of the pressure levels in increasing order. At each pressure level, the pilot which is preset to that level is actuated and accordingly admits power fluid to the related well valve. After the application of each pulse, the pressure in the control line is reduced to a maintenance level.

In an alternate embodiment of the invention, the pulses applied are decreases in pressure which produce a sequence of decreasing pressure levels. The pressure decrease is of a magnitude greater than the pressure increment of the standard pressure step. After the application of the pulse, the pressure in the conduit is increased to a maintenance level.

The principal advantage of this invention is a reduction in the time required for the transmission of fluid pressure signals through conduits. The method is especially advantageous for transmission through long pressure lines and for use in conjunction with oil-based fluids.

BRIEF DESCRIPTION OF THE DRAWINGS

In order to more fully understand the drawings used in the detailed description of the present invention, a brief description of each drawing is provided.

DETAILED DESCRIPTION OF THE PREFERRED EMBODIMENT

Figure 1:
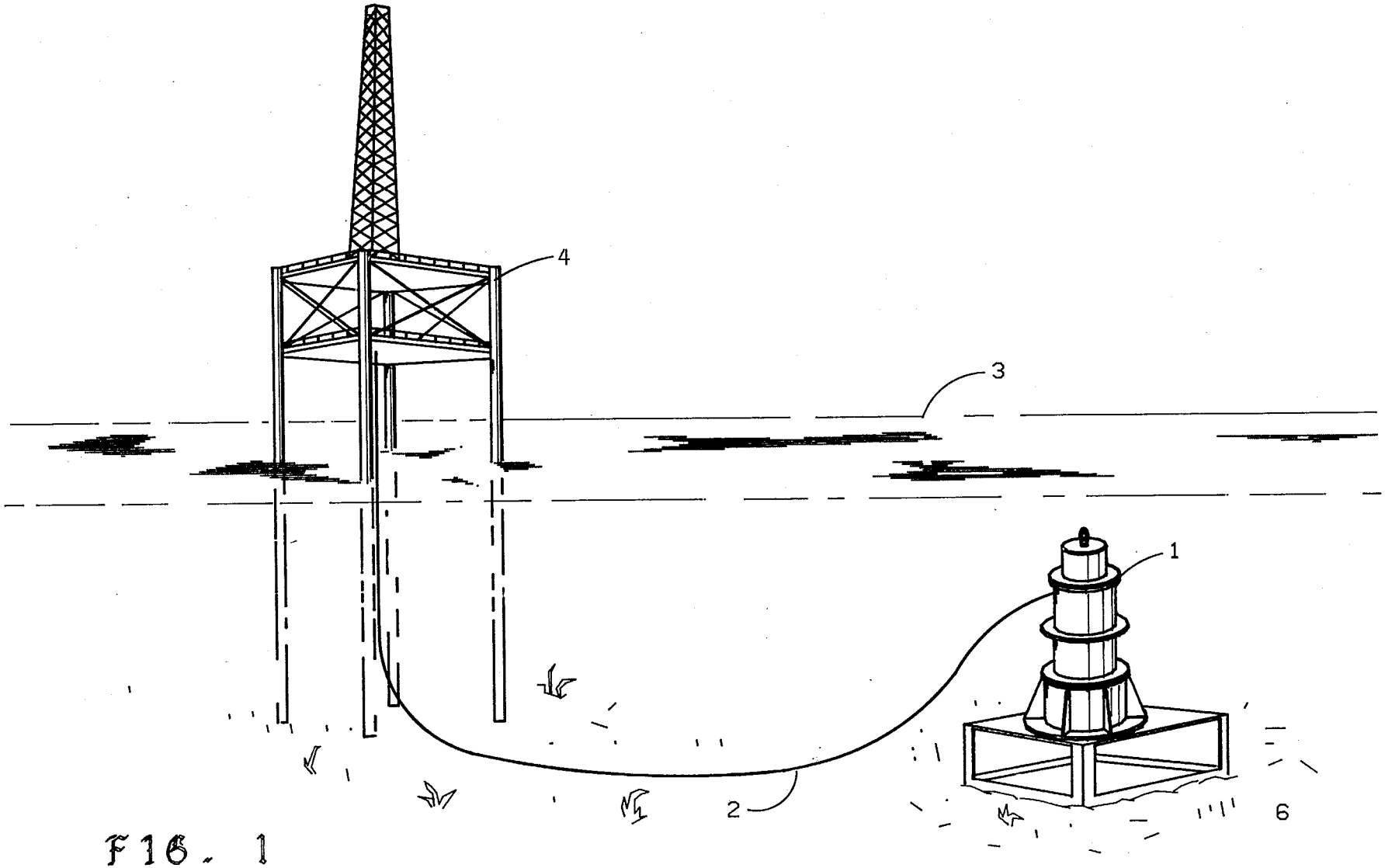
FIG. 1 is a pictorial representation of an offshore wellhead connected to a fixed platform by a long fluid pressure control line.

Utilization of the present invention in an offshore oil production facility is depicted in FIG. 1. The wellhead 1 of an offshore oil well is shown on the sea floor 6 and is connected to a long fluid pressure control line 2. The pressure line 2 extends from the wellhead 1 to a distant fixed production platform 4. Line 2 is supplied with hydraulic fluid by means of a pump and fluid tank system (not shown) located on platform 4. The pumping system is capable of pressuring the line to various levels to operate valves on the well which regulate fluid flow through the well.

Figure 2:
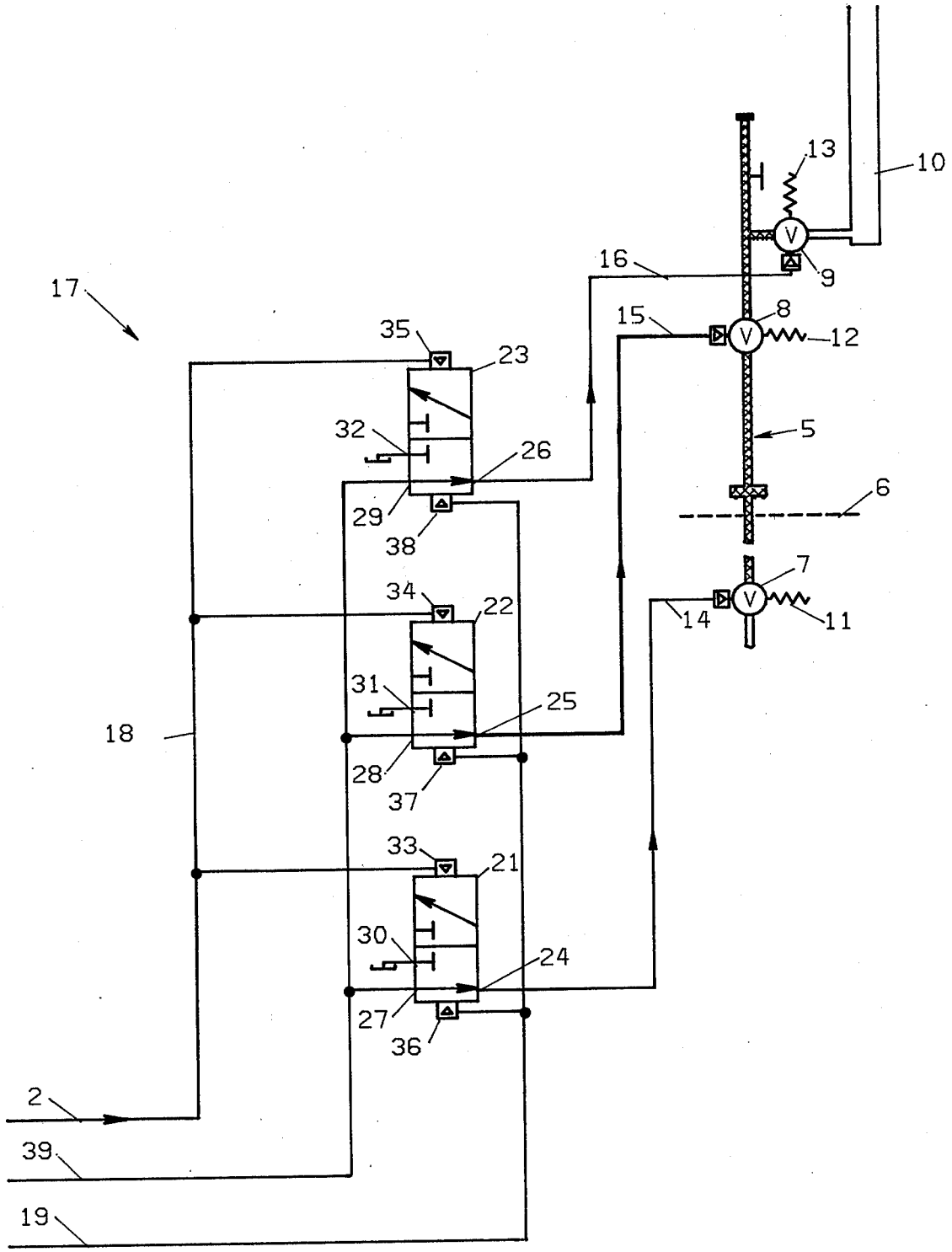
FIG. 2 is a schematic diagram of three wellhead valves and an associated control system with the pilot valves in the actuating mode.

The valves on the well to be controlled and the control system for controlling the valves are shown schematically in FIG. 2. Tubing string 5 extends below the sea floor 6 and is equipped with three valves, 7, 8 and 9. The portion of the tubing string 5 above the sea floor 6 is connected to an oil production line 10. The lowermost valve 7 is a downhole safety valve; the center valve 8 is the master production valve; and the uppermost valve 9 is a production wing valve that controls the flow of oil to the production line 10.

Before production from the well is begun, the three valves 7, 8 and 9 are in closed positions. Safety valve 7 is normally held in a closed position by spring 11 and is hydraulically actuated to an open position through hydraulic line 14. Likewise, master valve 8 and wing valve 9 are normally held closed by springs 12 and 13, respectively, and can be hydraulically actuated to an open position through hydraulic lines 15 and 16, respectively. The desired operating procedure for beginning production is first to open the safety valve 7, then the master valve 8 and finally the wing valve 9.

The hydraulic control system, generaly indicated by the reference numeral 17, controls the opening and closing of valves 7, 8 and 9 and is supplied with hydraulic control fluid by pressure control line 2 extending from the remote control point on platform 4. Control line 2 provides pressure signals for operation of the control system 17. Control line 2 is initially biased to some pressure level, for example, 1500 psig (105.5 kg/cm$^2$). Command pressure manifold 18 is connected to control line 2 and receives the pressure signals from the remote control point. Reference pressure line 19 is maintained at a predetermined pressure level, for example, 1200 psig (84.37 kg/cm$^2$). Hydraulic power line 39 provides power fluid at some pressure sufficient to overcome the force of springs 11, 12 and 13 for opening well valves 7, 8 and 9. Reference line 19 and power line 39 can be supplied with fluid from accumulators on platform 4 or from subsea accumulators. Alternatively, these two lines can be supplied with fluid through control line 2. Pressure regulators can then be used to maintain the pressures in reference line 19 and power line 39 at the desired constant level while the pressure in control line 2 is increased.

Three pilot valves 21, 22 and 23 are provided, one of which is connected to each of the three well valves 7, 8 and 9. Thus, the outlet 24 of pilot valve 21 is connected to hydraulic line 14 for controlling safety valve 7, the outlet 25 of pilot valve 22 is connected to line 15 for controlling master valve 8, and the outlet 26 of pilot valve 23 is connected to line 16 for controlling wing valve 9. The inlets 27, 28 and 29 of the pilot valves 21, 22 and 23, respectively, are connected to power line 39. When pilot valve 21 is in the actuating mode, inlet 27 and outlet 24 of pilot valve 21 are in fluid communication, power fluid can flow from power line 39 to line 14, and safety valve 7 is controlled to an open position. Likewise, when inlet 28 and outlet 25 of pilot valve 22 are in fluid communication, master valve 8 is opened. And when inlet 29 and outlet 26 of pilot valve 23 are in fluid communication, wing valve 9 is opened. The pilot valves 21, 22 and 23 are shown schematically in the actuating mode in FIG. 2.

Figure 3:
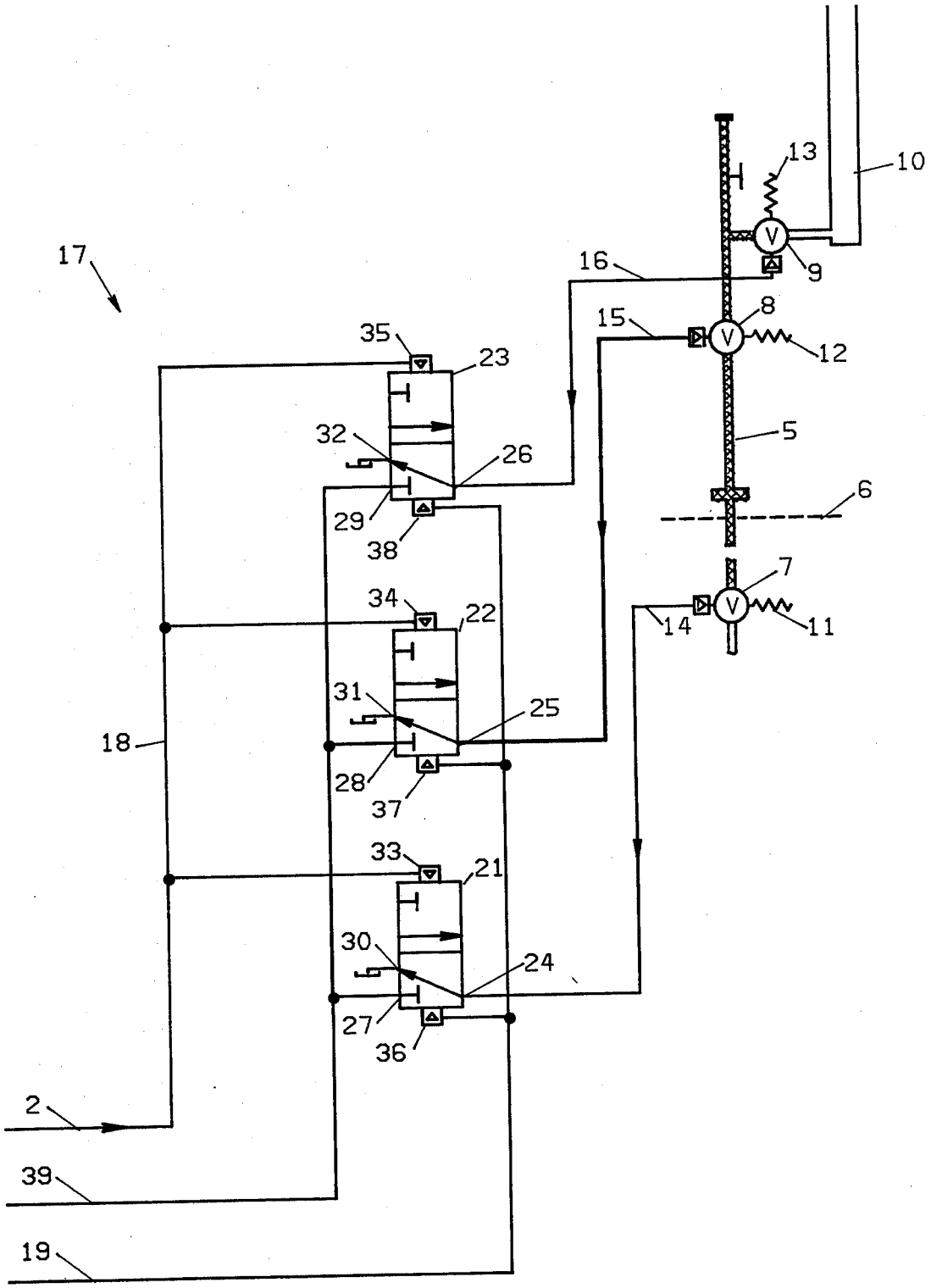
FIG. 3 is a schematic diagram of three wellhead valves and an associated control system, similar to FIG. 2, with the pilot valves in the venting mode.

Pilot valves 21, 22 and 23 also have vents 30, 31 and 32, respectively. When pilot valve 21 is in the venting mode, outlet 24 is aligned with vent 30 so that line 14 is in communication with vent 30, power fluid is vented from line 14, and safety valve 7 is in its normal closed position. Pilot valves 22 and 23 operate analogously in the venting mode to maintain valves 8 and 9, respectively, in the closed position. In the schematic representation in FIG. 3, the pilot valves 21, 22 and 23 are shown in the venting mode.

The pilot valve are actuated by means of pilot ports. Pilot valve 21, for example, has a first pilot port 33 connected to command manifold 18 and a second pilot port 36 connected to reference line 19. Pilot valve 21 is preset such that when the pressure at first pilot port 33 exceeds the pressure at second pilot port 36 by a preselected first pressure differential, for example 540 psi (38.0 kg/cm$^2$), inlet 27 comes into alignment with outlet 24 so that pilot valve 21 is in the actuating mode and safety valve 7 is controlled to its open position. Since the pressure at second pilot port 36 is the reference pressure of 1200 psig in reference pressure line 19, the first pressure differential of 540 psi is achieved in pilot valve 21 to open valve 7 when command manifold 18 reaches a preselected first pressure level of 1740 psig (122.3 kg/cm$^2$).

Pilot valve 22 has a first pilot port 34 connected to command manifold 18 and a second pilot port 37 connected to reference line 19. Pilot valve 22 is preset such that when the pressure at first port 34 exceeds the pressure at second port 37 by a preselected second pressure differential of 940 psi (66.1 kg/cm$^2$), greater than first pressure differential 540 psi, inlet 28 and outlet 25 come into alignment so that pilot valve 22 is in the actuating mode. Thus, when command manifold 18 reaches a preselected second pressure level of 2140 psig (150.5 kg/cm$^2$), higher than first pressure level 1740 psig, the second pressure differential of 940 psi is achieved in pilot valve 22 and master valve 8 is opened.

Similarly, pilot valve 23 has first pilot port 35 connected to command manifold 18 and second pilot port 38 connected to reference line 19. Pilot valve 23 is preset such that when the pressure at first port 35 exceeds the pressure at second port 38 by a preselected third pressure differential of 1340 psi (94.22 kg/cm$^2$), greater than second pressure differential 940 psi, inlet 29 and outlet 26 come into alignment and wing valve 9 is opened. The third pressure differential 1340 psi is achieved in pilot valve 23 when a preselected third pressure level of 2540 psig (178.6 kg/cm$^2$), higher than second pressure level 2140 psig, is reached in command manifold 18.

In order to open the three well valves in the desired order, safety valve 7 first, master valve 8 next, and wing valve 9 last, pressure signals must be applied at the platform 4 through pressure line 2 to achieve the three required pressure levels of 1740, 2140 and 2540 psig in command manifold 18. When first pressure level 1740 psig is achieved in command manifold 18, pilot valve 21 will move into the actuating mode and will open safety valve 7. At this pressure level, pilot valves 22 and 23 will remain in the venting mode and master valve 8 and wing valve 9 will remain closed. When second pressure level 2140 psig is reached in command manifold 18, pilot valve 22 will move into the actuating mode and open master valve 8. Pilot valve 23 will remain in the venting mode and wing valve 9 will remain closed. Finally, when third pressure level 2540 psig is reached in command manifold 18, the last pilot valve 23 will move into the actuating mode and will open wing valve 9.

Figure 4:
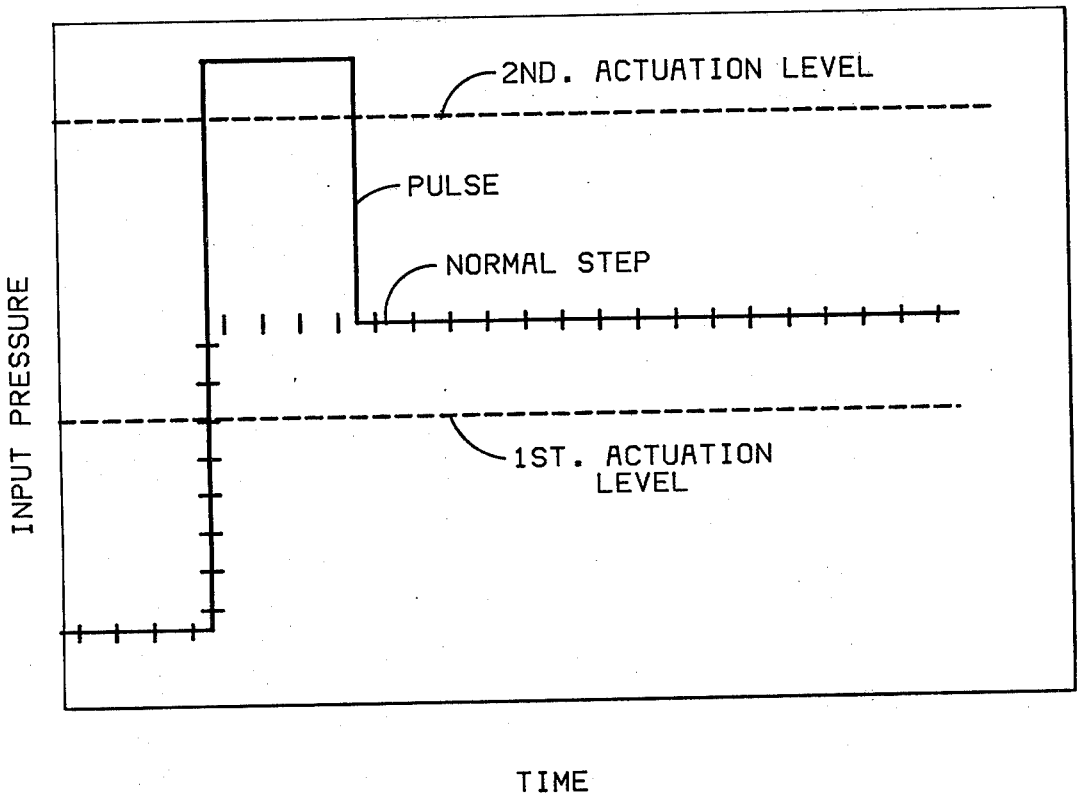
FIG. 4 is a graph illustrating the general shapes of an input pressure step and an input pressure pulse as a function of time for the case of increasing pressure levels.

In the past, the required pressure levels in command manifold 18 have been achieved by applying a series of increasing input pressure steps to control line 2 at the remote source. As used herein, the terms "pressure step" and "pressure pulse" refer to a change in pressure, whereas the terms "pressure" and "signal" refer to a particular pressure level. The input pressure step applied is normally greater than the increase in output pressure required to reach the predetermined actuation pressure of the device with the required pressure increase being about 60% of the actual step applied. Thus, references herein to the conventional pressure step mean a change in pressure equal to about 1.67 times the pressure change required to achieve a particular actuation pressure. In the present example, to achieve the first required output pressure of 1740 psig in command manifold 18, an increase of 240 psi (16.9 kg/cm$^2$) to the initial bias pressure of 1500 psig is required. An actual pressure step of 400 psi (28.1 kg/cm$^2$) would conventionally be applied at the control point to increase the input pressure to the line to 1900 psig (133.6 kg/cm$^2$). To achieve the next required output pressure of 2140 psig, another pressure step of 400 psi would be applied to increase the input pressure to 2300 psig (161.7 kg/cm$^2$). To achieve the final required output pressure of 2540 psig, a final pressure step of 400 psi would be applied to increase the input pressure to 2700 psig (189.8 kg/cm$^2$). The general shape of an input pressure step is shown by the hatch marks in FIG. 4.

Figure 5:
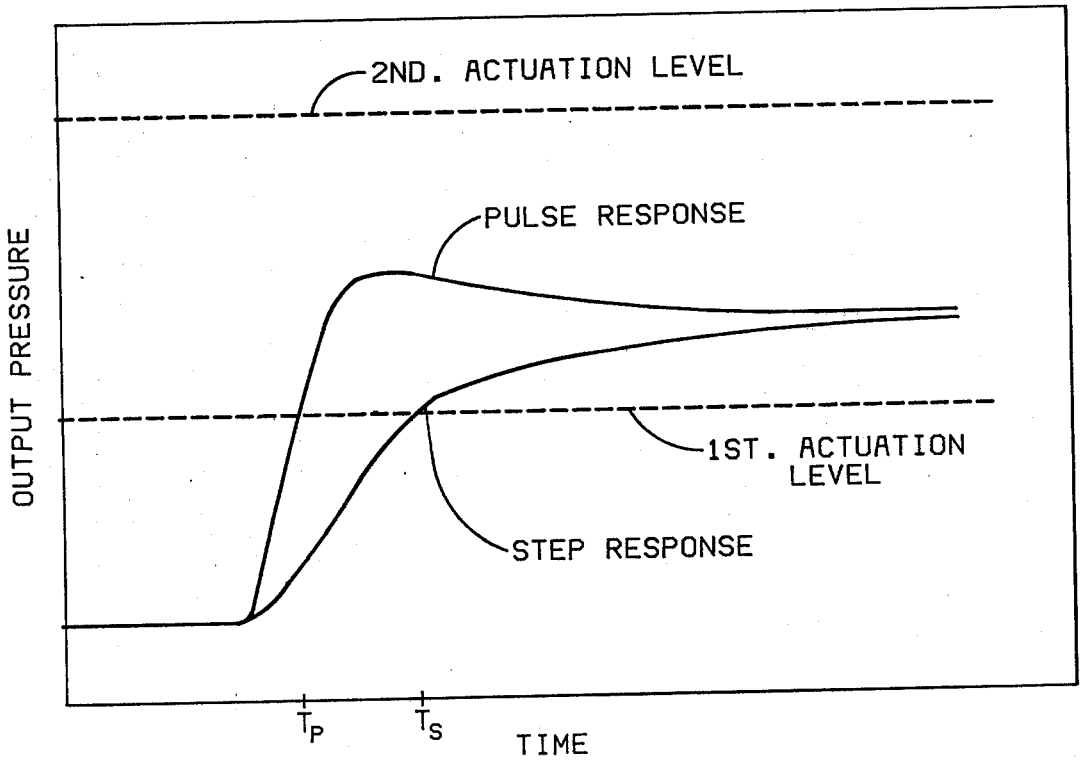
FIG. 5 is a graph illustrating the general shapes of the output pressure response curves for the two input pressure signals represented in FIG. 4.

Although the nominal speed of the pressure signal traveling through control line 2 is the velocity of sound in the particular fluid medium, the actual speed is slower. A smoothing of the leading edge of the pressure step is caused by a dispersion of wave frequencies. Thus, a long delay occurs between the application of the 400 psi input pressure step and achievement of the first actuation pressure of 1740 psig in command manifold 18. FIG. 5 shows the general shape of the output pressure response as a function of time for an input pressure step. The time required for the output pressure to achieve the first actuation level, the trip time, is designated as $T_s$ for the case of an input pressure step.

A more rapid trip time is obtained according to the present invention by applying a pressure pulse to control line 2 rather than the standard pressure step. The magnitude of the pulse is substantially greater than the conventional pressure step. In the system presented here, a pressure pulse of, for example, 800 psi would be applied instead of a pressure step of 400 psi. Thus, to achieve the first actuation level, the input pressure would be increased to 2300 psig rather than 1900 psig. After the pulse is applied for a brief period, the input pressure is reduced to a maintenance level, preferably equal to the pressure level resulting from application of the conventional pressure step. For example, in the present system, the input pressure would be reduced from 2300 psig to 1900 psig. The length of time for which the pulse is applied is less than the time required for actuation in the case of the pressure step method ($T_s$ in FIG. 5). The general shape of an input pressure pulse is shown as a solid line in FIG. 4.

In applying the described pulse, the dispersion effect on the pressure signal traveling through the control line is minimized due to an increase in the amplitude of high frequency components of the composite wave form. The time for actuation of a device is therefore decreased. The shape of an output pressure response curve for an input pressure pulse is shown in FIG. 5. In the case of a pulse, the time required for the output pressure to reach the first actuation level, $T_p$, is less than the trip time in the case of a step, $T_s$. The decrease in trip time is the difference between $T_s$ and $T_p$. The output pressure remains below the second actuation level at all times during the transmission of the first pressure pulse.

Referring to the present control system, the application of an 800 psi pressure pulse causes the preselected first pressure level of 1740 psig to be reached in command manifold 18 more quickly than does the application of a 400 psi input pressure step. Pilot valve 21 is therefore moved into the actuating mode more quickly and safety valve 7 is opened more quickly. During the actuation of pilot valve 21, the pressure in command manifold 18 is at no time allowed to reach the preselected second pressure level of 2140 psig so that pilot valve 22 remains in the venting mode.

After safety valve 7 is opened, master valve 8 and wing valve 9 are actuated sequentially in a similar manner. The input pressure to control line 2 is increased by 800 psi, from 1900 psig to 2700 psig for a brief period, and then reduced to a maintenance level of 2300 psig. The preselected second pressure level of 2140 psig will be reached in command manifold 18 more rapidly than in the conventional method. Pilot valve 22 is moved into the actuating mode and causes master valve 8 to be opened more rapidly. During the transmission of this second pressure pulse, the pressure in command manifold 18 remains below the preselected third pressure level of 2540 psig at all times, ensuring that pilot valve 23 remains in the venting mode and wing valve 9 remains closed.

Finally, a third pressure pulse of 800 psi is applied for a brief period to increase the input pressure from 2300 psig to 3100 psig. The input pressure is then reduced to 2700 psig as the maintenance level. Pilot valve 23 is actuated and causes wing valve 9 to be opened rapidly. During the transmission of this last pulse, the method of the invention places no limit on the output pressure in command manifold 18 because no succeeding pilot valve which could inadvertently be actuated exists in the sequence.

The numerical values discussed above are given by way of example. Other values for the preset actuation pressures, the pulse magnitudes and the maintenance levels can be chosen as appropriate for a particular application of the invention.

For the transmission of a given pressure pulse to obtain a given actuation pressure in a sequence, the magnitude of the pulse and the period of its application are chosen to give a short trip time and to maintain the output pressure below the next higher actuation pressure in the sequence. In order to obtain a reduction in trip time over the conventional pressure step method, the pressure pulse must be greater than the conventional pressure step, as stated above. As further stated above, in order to avoid actuation of the next device in the sequence, the period of application of the pulse should generally be less than the trip time for the pressure step method. For effective utilization of this invention, these two parameters of magnitude and time for the transmission of a particular pulse will generally be within the following approximate ranges. The pulse magnitude will be between 1.5 and 3.0 times the magnitude of the conventional pressure step. The pulse period of application will be between 0.4 and 0.8 times the trip time for the pressure step method. More specifically, the pulse will be approximately twice the magnitude of the pressure step and the pulse period of application will be approximately 0.75 times the trip time for the pressure step method.

The maintenance level to which the input pressure is reduced after application of the pulse has upper and lower limits of feasibility. As a lower limit, the maintenance pressure must be at least equal to the preset actuation pressure of the device being actuated in order to maintain its actuation. As an upper limit, the maintenance pressure must be less than the preset actuation pressure of the succeeding device in the sequence in order to prevent its actuation. Where the device being actuated is not followed by another device in a sequence, the upper value of the maintenance pressure is not limited. Within the stated limits, a convenient choice for the maintenance pressure is the pressure which would have been reached by the application of the conventional pressure step.

Figure 6A:
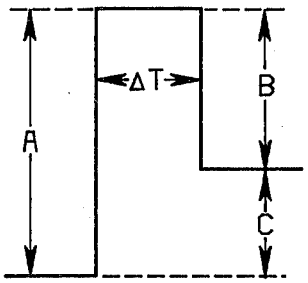
FIG. 6A is a representation of the components of an input pressure pulse.

For the application of the present method to a specific control system where the pulse magnitude A and the maintenance pressure C have been selected and the responses of the system for at least two input pressure steps are known, an optimal time period $\Delta T$ for application of the pulse can be approximated by a graphical method. In the representation of FIG. 6A, for a system initially at atmospheric pressure, a pulse of magnitude A is applied for a time period $\Delta T$ and then reduced to a maintenance level C. The pulse can be modeled as an upward pressure step of magnitude A followed by a downward step of magnitude B after a time period $\Delta T$. The downward step B can be modeled as the sum of a downward step A and an upward step C.

Figure 6B:
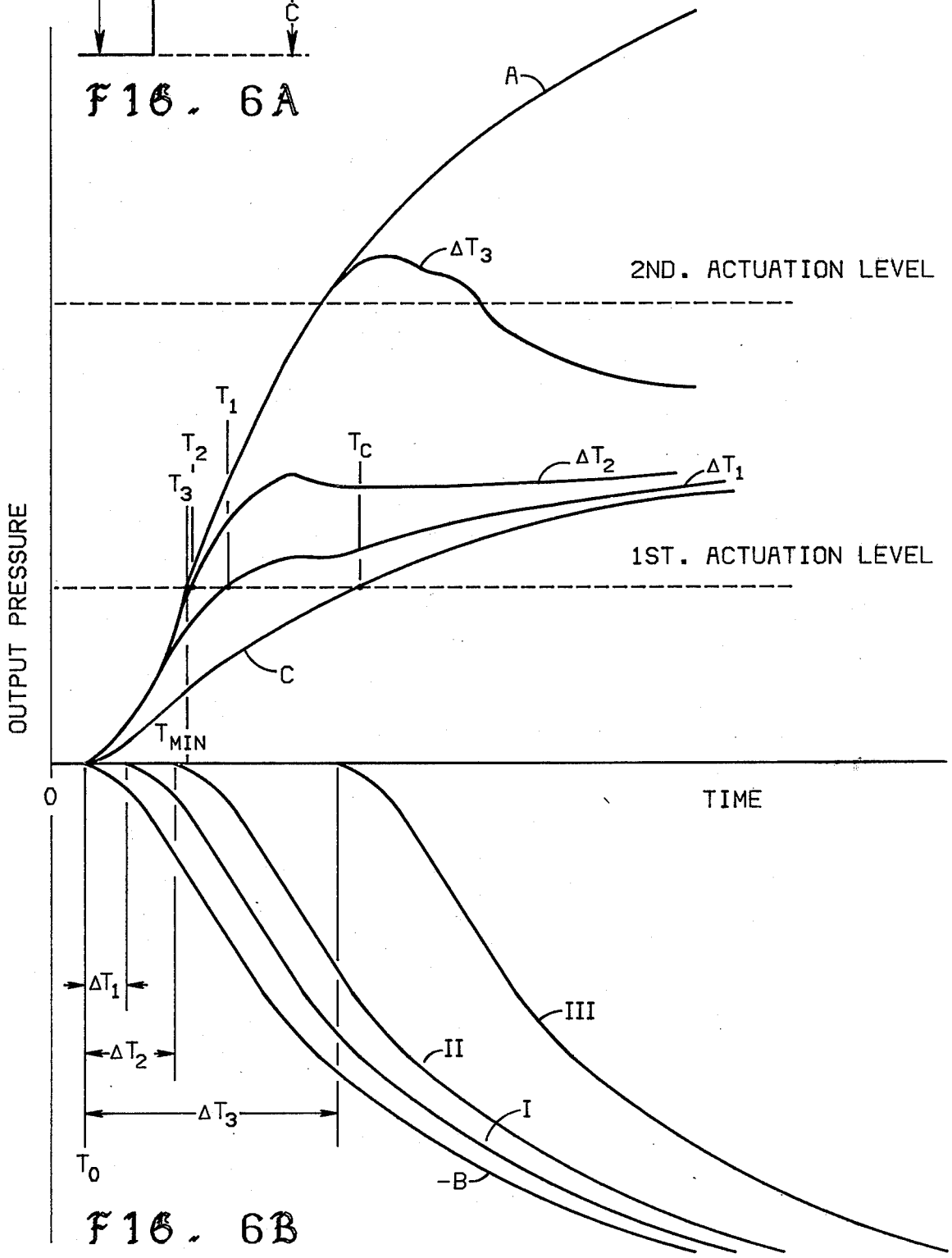
FIG. 6B is an illustration of a graphical method for determining the optimal application period for a pressure pulse.

Referring now to FIG. 6B, the known output pressure response as a function of time resulting from the application of an input pressure step of magnitude A is drawn as curve A. Curve $-B$ is the known output pressure response for an input pressure step of magnitude B drawn as negative to represent a downward step. The known response for the input pressure step C is drawn as curve C which reaches the first actuation level at time $T_c$. Where the response for the step B is unknown, it can be approximated by subtracting the ordinates of curve C from the ordinates of curve A. The result obtained is only an approximation because it is based on the assumption that the response curves are linearly proportional to the input step amplitude. The response curves A, $-B$ and C originate on the time axis at $T_o$ which is the one-way acoustic travel time in the conduit. Because the response curve for the input pulse applied will rise along curve A for a time period equal to the $\Delta T$ chosen, the time at which curve A reaches the first actuation level, $T_{min}$, is the minimum time at which actuation can be achieved with an input pulse of the chosen magnitude A.

Turning to the optimization of the pulse application period $\Delta T$ for the pulse magnitude A, a trial procedure is followed. First, a time period $\Delta T_1$ is selected for trial and a response curve $\Delta T_1$ for an input pulse of magnitude A applied for time period $\Delta T_1$ is constructed in the following manner. Curve $-B$ is shifted on the time axis from $T_o$ by the distance $\Delta T_1$ to yield curve I. The ordinates of curve I are then added to the ordinates of curve A to produce curve $\Delta T_1$. Curve $\Delta T_1$ reaches the first actuation level at the time $T_1$, which is less than $T_c$.

The above procedure is then repeated for other trial time periods. For the time period $\Delta T_2$, curve $\Delta T_2$ is constructed by shifting curve $-B$ by the distance $\Delta T_2$ to yield curve II which is then added to curve A. In the case of response curve $\Delta T_2$, the first actuation level is reached at time $T_2$, which is less than both $T_c$ and $T_1$. A response curve $\Delta T_3$ for time period $\Delta T_3$ is constructed in the same manner by shifting curve $-B$ the distance $\Delta T_3$ to yield curve III which is added to curve A. Curve $\Delta T_3$ reaches the first actuation level at time $T_3$, less than $T_1$ and $T_2$ and equal to the minimum actuation time, $T_{min}$. Although a greater number of trials can be made, only three are discussed here for purposes of illustration.

Among the three trail time periods, the response for $\Delta T_3$ achieves first level actuation most rapidly. However, curve $\Delta T_3$ also reaches the second actuation level and would therefore cause the second device in a sequence to be actuated. Because that result is not desired, time period $\Delta T_3$ is unsuitable for the present application. Next, directing attention to curves $\Delta T_1$ and $\Delta T_2$, it is observed that the second actuation level is not reached by either of these curves. Both $\Delta T_1$ and $\Delta T_2$ are therefore suitable time periods. Since the actuation time for $\Delta T_2$, $T_2$, is less than the actuation time for $\Delta T_1$, $T_1$, time period $\Delta T_2$ is preferable to $\Delta T_1$. It is concluded that, among the three trial time periods, $\Delta T_2$ is the optimal. The use of time period $\Delta T_2$ results in the most rapid actuation of the first device in the sequence while clearly avoiding actuation of the second device. The preceding optimization method is an approximation rather than a precise method because it assumes that the response curves for the various input steps are linearly proportional to the input step amplitude.

The applicability of the present invention to a specific fluid control system depends on the particular fluid used and on the dimensions of the transmission line as incorporated in the damping number, a dimensionless constant for a control system. The dimensionless damping number, Dn, is defined in the following equation:

$$Dn = \mu L / \rho c r^2 \quad (1)$$

where $\mu$ = dynamic viscosity of fluid
L = length of transmission conduit
$\rho$ = density of fluid
c = velocity of sound in conduit
r = inside radius of conduit The pressure pulse method will achieve a reduction in trip time over the pressure step method and will therefore be useful for systems in which the damping number, Dn, is greater than or equal to 0.15.

Although the invention has been described in connection with a sequence of increasing pressure levels in a control system, it is also applicable to the control of a system by attaining a sequence of decreasing pressure levels. The input pulse applied is then a pressure decrease which causes a decrease in output pressure. The magnitude of the pressure decrease is greater than the downward pressure step which would be conventionally applied in such a system. After the application of the pulse, the input pressure to the line is increased to a maintenance pressure which is no greater than the desired actuation level and which is greater than the following actuation level in the decreasing sequence. Preferably, the maintenance pressure is equal to the pressure level which would have been reached by applying the conventional downward pressure step. A reduction in trip time over the conventional method is achieved. The optimal time period for application of the downward pulse in a particular system can be approximated by a graphical procedure analogous to that described above. It should be appreciated that in order to apply the present invention to the attainment of low pressure levels in a decreasing sequence, it may be necessary to initially bias the system to some pressure level above ambient pressure.

The present invention has been discussed in conjunction with pilot valves used to control subsea well valves. It is also within the scope of this method to actuate any other fluid pressure responsive devices in a fluid control system employed in other technological fields. In the present disclosure, a group of three devices has been described for simplicity. Any number of devices in a system with an equal number of pressure levels may be actuated in the manner disclosed. The actuation of a group of devices is not limited to a strict ascending or descending order of pressure levels. Devices may be actuated in accordance with this method in any order in a complex control system at the choice of those in the art.

In a modification of the embodiment described, several devices can be controlled by a single pilot valve of the type disclosed in U.S. Pat. No. 3,952,763 having multiple pairs of pilot ports wherein each pair comes into alignment in response to a different pressure level. In accordance with the present invention, an input pressure pulse is introduced to achieve each of the pressure levels and bring each of the pairs of ports into alignment more rapidly than with an input pressure step.

EXPERIMENTS

Experiments were conducted to determine response times for the transmission of pressure pulses through a long conduit and to compare them to response times for conventional pressure steps. Various input pressure signals were introduced to the beginning of the line and the resulting output pressure at the end of the line measured continuously during the transmission of the pressure signal.

The experimental transmission line was 20,400 feet (6220 meters) of coiled steel tubing with an inside diameter of 0.402 inches (1.02 cms) which was plugged at one end. A mineral oil with a density of 56 lb/cu ft (0.90 gm/cu cm), a viscosity of 14 centipoise and a bulk modulus of approximately 200,000 psi (14,000 kg/cm$^2$) was employed as the fluid medium. During the experiments, the temperature of the fluid was 38° C.

The line was initially filled with the hydraulic fluid at atmospheric pressure. Input pressure signals were applied to the line from an oil accumulator by means of an air operated fluid regulator driven by a set of air regulators, each air regulator providing one of the input pressure levels. Fluid pressures at the beginning and end of the line were measured with transducers connected at these two points. The measurements were converted from current to voltage by means of a resistor and were recorded on a chart recorder as a function of time during the transmission of each signal.

To establish the response of the system to input pressure steps, two initial runs were made for conventional input pressure steps of 440 psi (28.1 kg/cm$^2$) and 850 psi (59.8 kg/cm$^2$) by applying the step increase to the line and maintaining that input pressure while the output pressure rose. Next, three runs were made in accordance with the invention with an input pressure pulse of 850 psi (59.8 kg/cm$^2$). The pulse was applied for a different time period in each run and, after that time period, the input pressure was reduced to a maintenance level. The pulse magnitude, pulse application period and maintenance pressure for each of the three runs are shown in Table I.

TABLE I

| Pulse Number | Pulse Magnitude psi (kg/cm$^2$) | Pulse Application Period, Seconds | Maintenance Pressure psig (kg/cm$^2$) |
|---|---|---|---|
| 1 | 850 (59.8) | 7 | 450 (31.6) |
| 2 | 850 (59.8) | 22 | 440 (30.9) |
| 3 | 850 (59.8) | 31 | 415 (29.2) |

Figure 7:
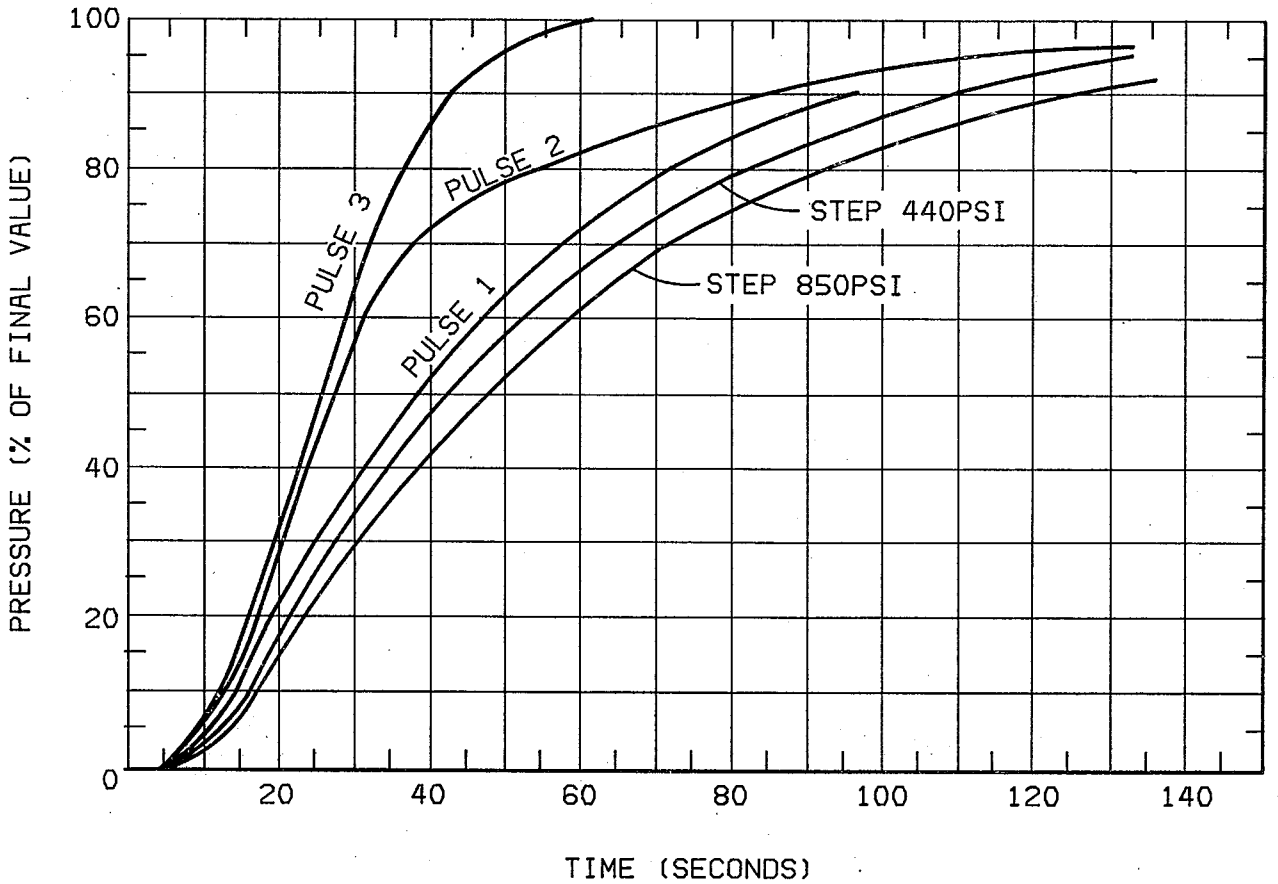
FIG. 7 is a graph of five response curves for a particular system in terms of normalized pressure versus time, based on experiments.

Output pressure data for each of the five runs were normalized to a percentage of final output pressure for purposes of comparison and are presented as a function of time in FIG. 7. The origin of the time scale represents the time at which the input pressure signal was applied to the line. Each of the curves represents the output pressure history for one of the runs. It is estimated that an error of 5% was introduced to the experimental results due to the coiling of the tubing.

The time required for the output pressure to reach 50% of its final value provides a convenient basis for comparing the transmission speed of various input signals. As determined from FIG. 7, this 50% point is reached in 43 seconds in the case of the 440 psi input step and in 47 seconds for the 850 psi step. For the pulse inputs, the time required to reach 50% of the final output pressure was less: 38 seconds for pulse 1, 27 seconds for pulse 2 and 25 seconds for pulse 3. Little improvement in response time between pulse 2 and pulse 3 was achieved by increasing the pulse application period from 22 seconds to 31 seconds. Since an increase in the pulse application period beyond 31 seconds would yield little improvement in response time and could result in the output pressure overshooting to the next higher actuation level in a sequence, it is concluded that pulse 3 is near the optimal input signal for the system studied. The experiments clearly demonstrate the reduction in delay time achieved by the use of pulse signals instead of step signals. In the case of pulse 3, the time required to reach 50% of the final output pressure was reduced to 58% of the time required in the 440 psi step case.

Various modifications and alterations of this invention will become apparent to those skilled in the art without departing from the true scope of the invention defined in the claims. It should be understood that this invention is not to be unduly limited to the foregoing set forth for illustrative purposes.

What is claimed is:

1. In a method for transmitting a pressure signal through a fluid-filled conduit by introducing to the conduit a step change in input pressure to yield a first of at least two step input pressure levels, wherein, after a distinct actuation time, the change in output pressure at a distance location in the conduit resulting from said step change in input pressure is equal to a percentage of said step change in input pressure and a first of at least two output pressure levels is thereby generated, the improvement comprising:

(a) introducing to the conduit a pulse change in input pressure of a magnitude substantially greater than said step change in input pressure for a time period shorter than said actuation time, said greater magnitude and said shorter time period being chosen such that the output pressure at the distant location resulting from said pulse change in input pressure at no time reaches a second of said two output pressure levels; and (b) at the end of said shorter time period, changing the input pressure to the conduit to a maintenance level, said maintenance level being between said first output pressure level and said second output pressure level.

2. The method of claim 1 wherein said maintenance level is equal to said first step input pressure level.

3. The method of claim 1 wherein said greater magnitude is between about one and one-half and about three times the magnitude of said step change in input pressure and said shorter time period is between about 0.4 and about 0.8 times said actuation time.

4. The method of claim 1 wherein said greater magnitude is about twice the magnitude of said step change in input pressure and said shorter time period is about 0.75 times said actuation time.

5. In a method of actuating a device connected to a fluid-filled conduit by introducing to the conduit a step increase in input pressure to yield a first of at least two step input pressure levels, thereby increasing the output pressure in the conduit at the device to a first of at least two output pressure levels after a distinct actuation time, said increase in output pressure being equal to a percentage of said step increase in input pressure, wherein said first output pressure level effectuates a distinct position response by the device, the improvement comprising:

(a) introducing to the conduit a pulse increase in input pressure of a magnitude substantially greater than said step increase for a time period shorter than said actuation time, said greater magnitude and said shorter time period being chosen such that the output pressure at the device resulting from said pulse increase in input pressure is at all times lower than a second of said two output pressure levels; and (b) at the end of said shorter time period, decreasing the input pressure to the conduit to a level at least equal to said first output pressure level.

6. In a method of actuating a device connected to a fluid-filled conduit by introducing to the conduit a step decrease in input pressure to yield a first of at least two step input pressure levels, thereby decreasing the output pressure in the conduit at the device to a first of at least two output pressure levels after a distinct actuation time, said decrease in output pressure being equal to a percentage of said step decrease in input pressure, wherein said first output pressure level effectuates a distinct position response by the device, the improvement comprising:

(a) introducing to the conduit a pulse decrease in input pressure of a magnitude substantially greater than said step decrease for a time period shorter than said actuation time, said greater magnitude and said shorter time period being chosen such that the output pressure at the device resulting from said pulse decrease in input pressure is at all times higher than a second of said two output pressure levels; and (b) at the end of said shorter time period, increasing the input pressure to the conduit to a level no greater than said first output pressure level.

7. In a method of operating a first of at least two subsea oil well valves, the first and second of said well valves being operably connected to and controlled by corresponding first and second pilot valves, said pilot valves being preset with first and second actuation pressures, respectively, and being connected to a common fluid-filled line extending to a remote location, wherein an input pressure step is applied to the line at said remote location to generate said first actuation pressure in the conduit at the location of the pilot valves after a distinct actuation time, thereby actuating said first pilot valve and said first pilot valve thereby operating said first well valve, the improvement comprising:

(a) applying an input pressure pulse substantially greater than said pressure step to the line for a time period shorter than said actuation time, the magnitude of said pulse and said shorter time period being chosen such that said second pilot valve is not actuated and said second well valve is not operated; and (b) reducing said pulse to said pressure step at the end of said shorter time period.

8. In a method of operating a plurality of subsea oil well valves in a desired sequence, said well valves being operably connected to and controlled by a corresponding plurality of hydraulically-actuated pilot valves, said pilot valves being connected to a common hydraulic pressure line and being present to a corresponding sequence of progressively different actuation pressures, wherein a sequence of input pressure steps is applied to the line to generate said sequence of actuation pressure at the pilot valves after distinct actuation times, thereby sequentially actuating said pilot valves, said pilot valves thereby sequentially operating said well valves, the improvement comprising:

(a) applying a sequence of input pressure pulses corresponding to said sequence of pressure steps to the line, said pressure pulses being substantially greater than said corresponding pressure steps and being applied for time periods shorter than said actuation times for said corresponding pressure steps, the magnitudes of said pulses and said shorter time periods being chosen such that, during the operation of any well valve, the next well valve after said well valve being operated in said desired sequence is not operated; and (b) after the application of each of said pressure pulses, reducing said pulse to said pressure step corresponding to said pulse.

9. In a method of actuating a plurality of pilot valves in a desired sequence, said pilot valves being connected to a common fluid-filled line and being preset to a corresponding sequence of progressively different actuation pressures, wherein a sequence of pressure steps is applied to the line, each of said steps being selected to generate the actuation pressure of one of said valves in the conduit at the location of the valves after a distinct actuation time, the improvement comprising:

(a) applying a pressure pulse to the line, said pulse being substantially greater than the first pressure step in said sequence of pressure steps and being applied for a time period shorter than the actuation time of said first pressure step, the magnitude of said pulse and said shorter time period being chosen such that the valve corresponding to the next pressure step after said first pressure step in said sequence of pressure steps is not actuated;

(b) reducing said pressure pulse to said first pressure step; and (c) repeating steps (a)–(b) for each pressure step in said sequence of pressure steps after said first pressure step in sequence.

10. A method for transmitting a pressure signal through a fluid-filled conduit to generate a first of at least two output pressure levels, wherein a maintenance input pressure signal between said first output pressure level and a second of said two output pressure levels is selected and wherein a pulse input pressure signal of a magnitude substantially greater than said maintenance input pressure signal is selected, the method comprising:

(a) determining the output signal as a function of time generated by introducing said maintenance input pressure signal to the conduit;

(b) determining the output signal as a function of time generated by introducing said pulse input pressure signal to the conduit;

(c) determining the output signal as a function of time generated by introducing to the conduit an input pressure signal equal to said pulse input pressure signal less said maintenance input pressure signal;

(d) selecting a time period for application of said pulse input pressure signal;

(e) summing said time period with the output signal determined in step (c) to obtain a shifted signal;

(f) subtracting said shifted signal from the output signal determined in step (b) to yield a final output signal;

(g) repeating steps (d)–(f) for a plurality of time periods;

(h) selecting among said plurality of time periods, as the optimal time period, that time period which yields a final output signal reaching said first output pressure level most rapidly and at no time reaching said second output pressure level;

(i) introducing to the conduit said pulse input pressure signal for the optimal time period; and (j) reducing said pulse input pressure signal to said maintenance input pressure signal after the optimal time period.

11. The method of claim 10 wherein the determination of the output signal of step (c) is accomplished by subtracting the output signal determined in step (a) from the output signal determined in step (b).

* * * * *